United States Patent [19]

Jung

[11] 4,209,260

[45] Jun. 24, 1980

[54] WIRE MATRIX PRINT HEAD HAVING REVERSIBLE WIRE DRIVE ARMATURES TO ALLOW WIRE WEAR COMPENSATION

[75] Inventor: Friedrich Jung, Erlangen, Fed. Rep. of Germany

[73] Assignee: Triumph Werke Nurnberg, A.G., Nuremberg, Fed. Rep. of Germany

[21] Appl. No.: 974,224

[22] Filed: Dec. 29, 1978

[30] Foreign Application Priority Data

Jan. 4, 1978 [DE] Fed. Rep. of Germany ..... 2800218

[51] Int. Cl.[2] ..... B41J 3/12

[52] U.S. Cl. ..... 400/53; 400/124

[58] Field of Search ..... 400/124, 53; 101/93.05

[56] References Cited

U.S. PATENT DOCUMENTS

| | | | |
|---|---|---|---|
| 4,004,673 | 1/1977 | Burzlaff et al. | 400/124 |
| 4,009,772 | 3/1977 | Glaser et al. | 400/124 |
| 4,140,406 | 2/1979 | Wolf et al. | 400/124 |

*Primary Examiner*—Paul T. Sewell

*Attorney, Agent, or Firm*—Joseph R. Spalla

[57] ABSTRACT

A wire matrix print head having print wires subject to wear at their printing ends are biased by return springs against one side of one end of armatures, the other sides of which bear against a gap adjusting ring. The other end of each of the armatures is spaced by a predetermined gap from the pole piece of associated electromagnets which, when energized, drive the armatures about pivots intermediate the ends of the armature against the bias of the return springs. The ends of the armatures are formed with a step on the side initially placed in contact with the drive end of a print wire so that when the print wires are worn the armatures can be flipped over to present the unstepped side in contact with a drive wire with the result that upon movement of the adjusting ring to restore the gap between the armature and pole piece the print wires are pushed to a rest position closer to the printing plane by the depth of the step.

1 Claim, 3 Drawing Figures

WIRE MATRIX PRINT HEAD HAVING REVERSIBLE WIRE DRIVE ARMATURES TO ALLOW WIRE WEAR COMPENSATION

This invention relates to wire matrix print heads; more particularly, to wire matrix print heads having wire drive armatures having a step on one side in contact with the drive end of a print wire; and specifically, to wire print heads having armatures with a step on one side which are reversible to present the unstepped side to the drive end of a drive wire to allow for wire wear compensating adjustment by the depth of the step.

Needle or wire matrix printing heads are known, e.g. from U.S. Pat. No. 4,004,673. After a certain operating time of the needle printing head, it is necessary to regrind the printing ends of the needles. To this end, as taught by the above U.S. patent, the needle guide is made adjustable to expose the wire ends shortened by wear. However, after the ends of the printing needles are ground down beyond a certain measure, they must be replaced by new ones. This requires time for repairs and results in costs and thus is disadvantageous.

In accordance with the invention, the life of the wires or needles of the printing head can be increased considerably. In accordance with the invention, a wire matrix print head having print wires subject to wear at their printing ends are biased by return springs against one side of one end of armatures, the other sides of which bear against a gap adjusting ring. The other end of each of the armatures is spaced by a predetermined gap from the pole piece of associated electromagnets which, when energized, drive the armatures about pivots intermediate the ends of the armature against the bias of the return springs.

The ends of the armatures are formed with a step on the side initially placed in contact with the drive end of a print wire so that when the print wires are worn the armatures can be flipped over to present the unstepped side in contact with a drive wire with the result that upon movement of the adjusting ring to restore the gap between armature and pole piece the print wires are pushed to a rest position closer to the printing plane by the depth of the step.

An object of the invention is in the provision of a wire matrix print head assembly which will allow wire wear compensation and extend the life of printing wires.

Another object of the invention is in the provision of a wire matrix print head having wire drive armatures which have a step on one face which, following wear of wires, can be reversed to allow wire wear compensating adjustment.

Other objects and many of the attendant advantages of this invention will be readily appreciated as the same becomes better understood by reference to the following detailed description when considered in connection with the accompanying drawing in which like reference numerals designate like parts throughout the Figures thereof and wherein.

Figure 1:
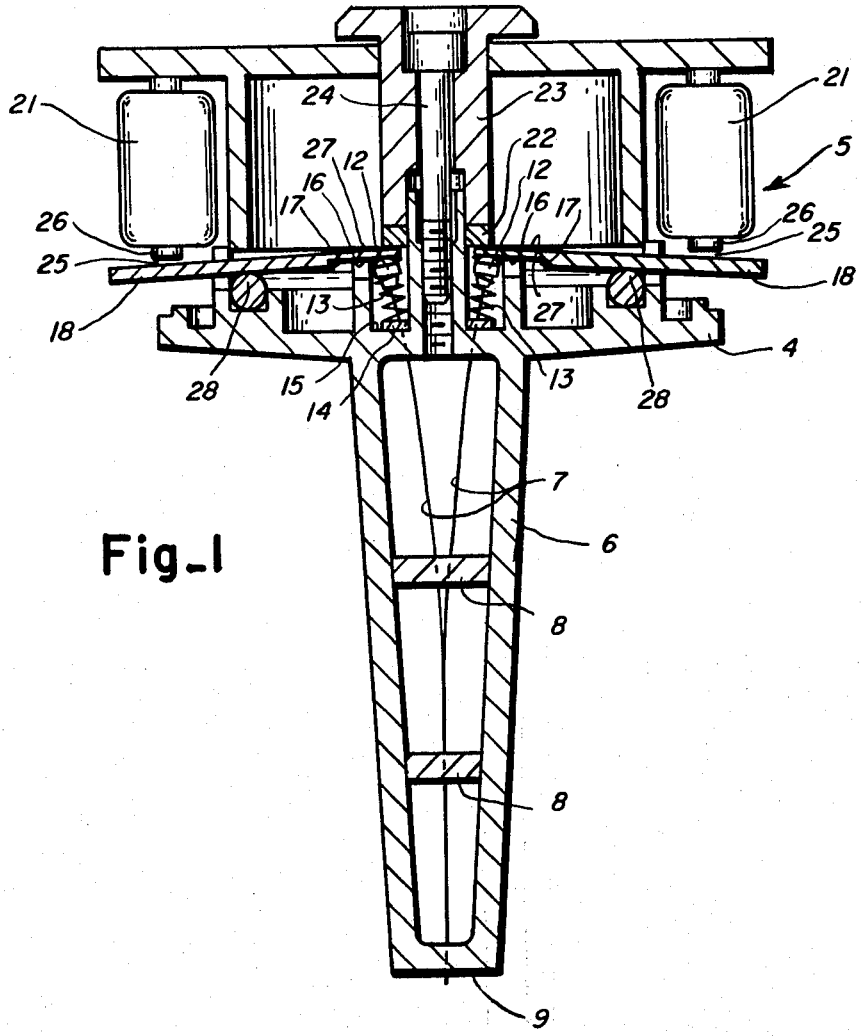
FIG. 1 is a transverse section through a needle printing head showing the arrangement of parts before wear of the printing ends of the needles.
Figure 2:
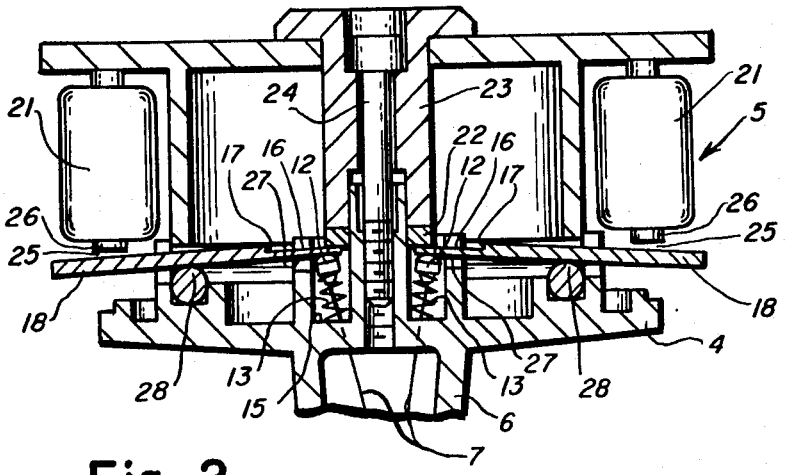
FIG. 2 is a partial view similar to FIG. 1 after worn needles have been adjusted to extend further following reversal of the armatures and adjustment of the magnet gap.
Figure 3:
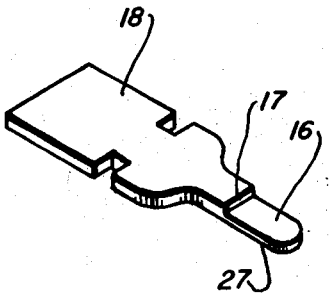
FIG. 3 is a perspective view of an oscillating armature according to the invention.

Referring now to the drawing there is shown in FIG. 1, a housing 4 of a needle printing head assembly generally designated by reference numeral 5 which is formed with an elongated wire or needle guide 6. Printing needles 7 are guided in cross pieces 8 of and protrude from the printing end 9 of the needle guide 6. At their drive ends, the printing needles 7 are provided with heads 12 which, under the action of return springs 13 surrounding the wires 7 and located between the heads 12 and a perforated disc 14 located on a bearing face 15 on the housing 4, act against a face 16 defined by a step 17 on one side of the ends of armatures 18, associated with electromagnets 21 on an electromagnet assembly, and urge the armatures 18 against a damping ring 22 of a sleeve 23 which can be displaced by means of a screw 24 to adjust the gap 25 between armatures 18 and the pole pieces 26 of the electromagnets 21. When so adjusted, the ends of new needles 7 protrude from the printing end 9 of the guide 6 a predetermined distance as shown in FIG. 1. After some use, the needles 7 are shortened by wear and by dressing as by grinding to equal lengths until they are too short for proper printing. When this state of the needles is reached, the magnet assembly is taken off, disc 14 is removed and the armatures 18 of all of the electromagnets 21 are rotated 180° in their longitudinal direction, with the result that face 16 of step 17 no longer serves as the bearing for the head 12 of the printing needles 7, but opposite face 27. Following reversal of the armatures 18, the ring 22 is inwardly adjusted to restore the gap 25, widened by the movement of the armatures 18 closer to the ring about their pivots 28, to its original setting as shown in FIG. 2. As the face 27 of the armatures in contact with the heads 12 of the needles 7 is not recessed, the readjustment of the gap 25 to its original setting causes the needles 7 to be set farther forward by the height of the step 17 so that they again protrude from the printing end 9.

As noted before, disc 14 between the springs 13 and bearing face 15 is removed in order to obtain the same spring tension as before. If disc 14 has a thickness which corresponds to the height of step 17, it is evident that the spring tension remains the same. The printing properties of the printing head are thus not changed when the armatures 18 are reversed and the gap 25 adjusted.

It is readily evident that by designing the printing head according to the invention, the life of the printing needles can be increased in proportion as the steps 17 of armatures 18 permit adjusting the needles 7. Especially advantageous is the fact that this adjustment can be effected in a simple manner and hence quickly and without major cost.

The invention claimed is:

1. In a wire matrix printing head comprising a guide assembly for retaining a plurality of wires each of which has a driving end and a printing end, electromagnets including armatures positioned to drive said driving ends of said wires, adjusting means for controlling the gap between armatures and electomagnet pole pieces, and spring means for urging the drive ends of said wires and said armatures to a rest position, the improvement comprising a step on one side of said armatures presenting a face to the driving ends of said wires, and a disc having a thickness equivalent to the depth of said step, said return springs acting between said disc and the driving ends of said wires, said armatures being reversible to present the opposite faces thereof to the driving ends of said wires so that after removal of said disc said gap may be readjusted to its original setting thereby to cause wires shortened by wear to protrude farther from the printing ends of said guide assembly.

* * * * *